United States Patent [19]

Van Doorn et al.

[11] Patent Number: 4,771,665

[45] Date of Patent: Sep. 20, 1988

[54] BLADE QUALITY MONITOR

[75] Inventors: Donald W. Van Doorn; William D. Beeland, both of Columbus, Ga.

[73] Assignee: Lummus Industries, Inc., Columbus, Ga.

[21] Appl. No.: 90,762

[22] Filed: Aug. 28, 1987

[51] Int. Cl.[4] ..... B27B 5/28; B27B 13/00

[52] U.S. Cl. ..... 83/62.1; 83/67; 83/71; 83/347; 83/348; 83/522; 83/913

[58] Field of Search ..... 33/635, 626; 83/62, 83/62.1, 72, 522, 346, 347, 348, 913, 66, 67, 71, 299, 304, 305, 311

[56] References Cited

U.S. PATENT DOCUMENTS

| | | | |
|---|---|---|---|
| 1,957,769 | 5/1934 | Freeman | 83/522 |
| 3,154,818 | 11/1964 | Nagle | 83/913 |
| 3,485,120 | 12/1969 | Keith | 83/913 |
| 3,602,348 | 8/1971 | Mohr | 83/522 |
| 3,882,745 | 5/1975 | Garrett et al. | 83/311 |
| 4,202,229 | 5/1980 | Feldkämper | 83/311 |
| 4,498,362 | 2/1985 | Steinke et al. | 83/304 |
| 4,569,264 | 2/1986 | Van Doorn et al. | 83/913 |
| 4,681,002 | 7/1987 | Nakaya | 83/71 |

*Primary Examiner*—E. R. Kazenske
*Assistant Examiner*—Scott A. Smith
*Attorney, Agent, or Firm*—Jennings, Carter, Thompson & Veal

[57] ABSTRACT

A blade quality monitor for use with cutter reels having specifically identifiable blades utilize a sensor to detect the position of a physical anomaly on the reel. Additional sensors sense the force at the interface between the cutter reel, the material wrapped thereon and the associated pressure roller. The position of the physical anomaly is correlated with the sensed force to determine the magnitude thereof at each blade which is indicative of the condition of the blade with respect to sharpness or intactness.

16 Claims, 2 Drawing Sheets

FIG. 1
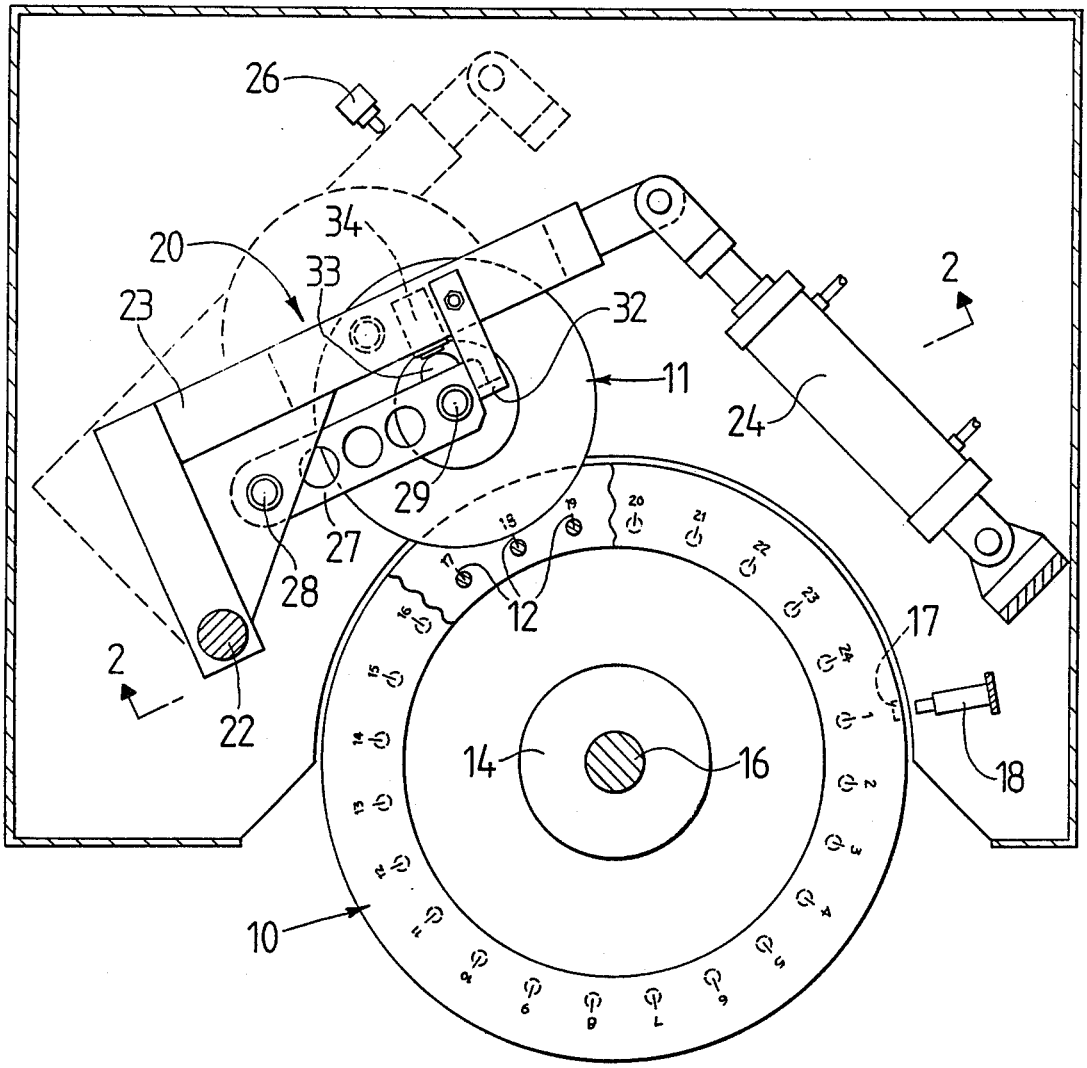
FIG. 2
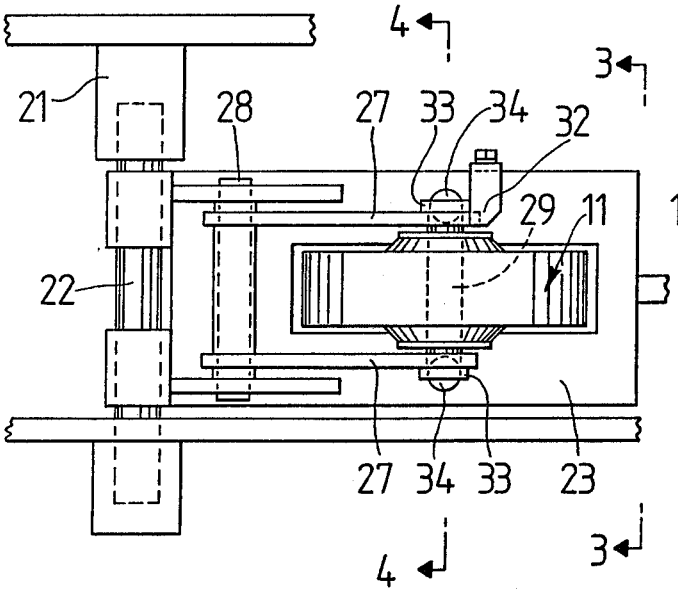
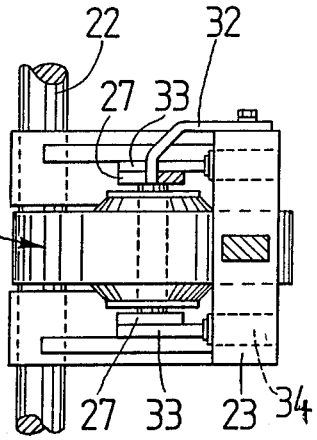
FIG. 3

BLADE QUALITY MONITOR

FIELD OF THE INVENTION

The present invention relates to the field of cutting elongated material such as tow into shorter lengths and more particularly to dynamically sensing the pressure exerted by the blades performing the cutting operation. In even greater particularity, the invention relates to sensing the pressure exerted at each blade of the cutter to determine the quality of the blade.

BACKGROUND OF THE INVENTION

The basic principles of the art are taught in U.S. Pat. No. 3,485,120 issued Dec. 20, 1969. As is well known, continuous filamentary material such as tow may be cut into short, spinnable lengths by wrapping the tow about a revolving reel carrying a plurality of radially and outwardly facing, equally spaced knives or cutter blades. A pressure roller is forced against the outer surface of the material wound about the reel so that the material is cut into short lengths from the inside of the coil or winding thereof. By using razor-like blades which are accurately equally spaced about the reel, uniform lengths of fibers are continuously cut as the apparatus revolves.

The art was improved on in U.S. Pat. No. 3,744,361 issued July 10, 1973 and assigned to the assignee hereof wherein it was recognized that holding the pressure roller to its work by an unyielding means had some undesirable consequences. The U.S. Pat. No. 3,744,361 patent disclosed mounting the pressure roller for movement toward or from the reel assembly, and sensing the pressure of the fiber against the roller to effect such movement away from the reel assembly.

In this manner, the sharpness of the blades was monitored to indicate when they should be replaced. While the apparatus built in accordance with these teachings were satisfactory, they leave something to be desired in terms of monitoring the quality of the individual blades.

SUMMARY OF THE INVENTION

It is the object of this invention to monitor the condition of the blades on a cutter apparatus and provide a dynamic indication of the status of each blade.

It is a further object of the invention to improve the quality of the material processed by the apparatus by providing means for assuring that the blades are at their optimum sharpness.

Yet another object of the invention is to provide an indication of blade condition which can be keyed to specific identifiable blades in the cutter apparatus.

These and other objects and advantages are accomplished in our apparatus by various improvements over the prior art which combine to provide a blade quality monitor of excellent quality. Essentially our device must sense the force exerted by the two on the pressure roller and correlate the pressure with a specific blade in the cutter assembly. The force exerted by the tow is sensed by a sensor or sensors mounted substantially in a plane intersecting the axis of the pressure roller and the axis of the cutter reel and detecting forces directed in the plane perpendicular to the axes of the pressure roller and reel. The forces are transmitted to the sensors by structures including the pressure roller which have minimized masses to reduce inertial damping of the force signals. The sensors are mounted on a high mass base and biased toward contact with the transmitting structures.

The specific blade is correlated with pressure through the use of a position sensor which detects the passage of a known point on the reel by a fixed point on the frame of the apparatus. The information supplied by this sensor and the force sensors are supplied to a CPU which correlates the signals to determine the force associated with each blade and displays the result on a human sensible indicator such as a CRT.

BRIEF DESCRIPTION OF THE DRAWINGS

Apparatus embodying features of our invention are depicted in the accompanying drawings which form a portion of this application and wherein:

FIG. 1 is a plan view of a portion of a cutter apparatus employing our invention;

FIG. 2 is an elevational view of the pressure roller and yoke of one embodiment of our invention taken along line 2—2 in FIG. 1;

FIG. 3 is an end view of the yoke mounting structure taken along line 3—3 of FIG. 2;

DESCRIPTION OF A PREFERRED EMBODIMENT

Figure 4:
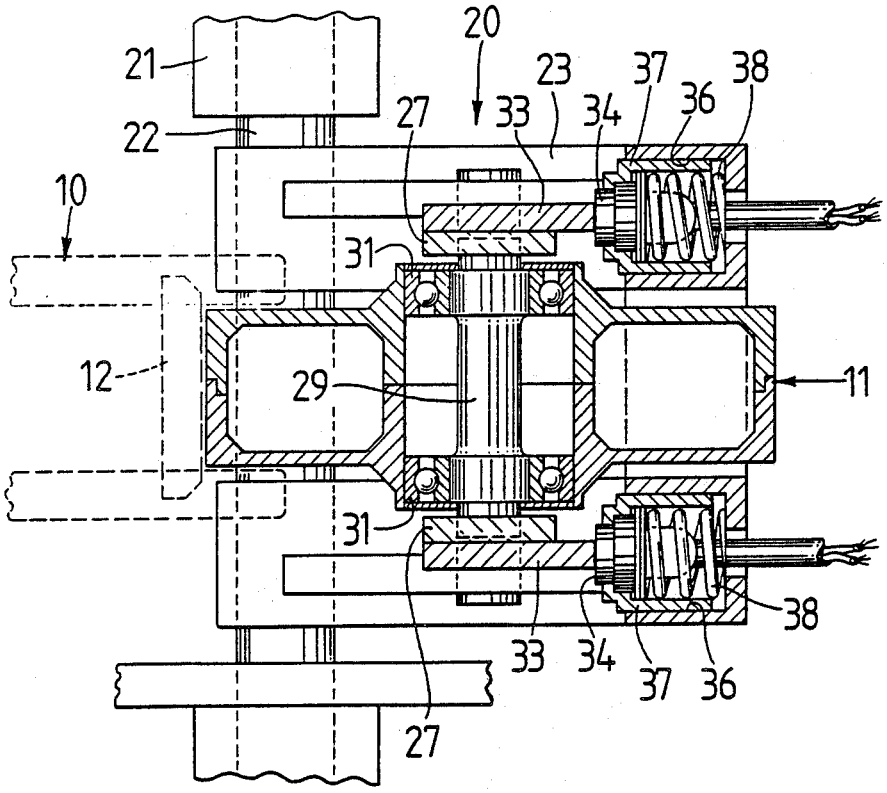
FIG. 4 is a sectional view taken through the center of the pressure roller along line 4—4 of FIG. 2.

It is to be understood that the present invention is an improvement to the process and apparatus disclosed in U.S. Pat. No. 3,744,361 owned by the common assignee herewith and the teachings of which are incorporated herein by reference. Referring now to the drawings for a better understanding of our invention, we show the same as embodying a driven blade carrying reel indicated generally at numeral 10 and a pressure roller 11 which is mounted for movement substantially radially toward and from reel 10. As is disclosed in U.S. Pat. No. 3,485,120, the material to be cut into short lengths is wound onto the reel 10 in successive layers and the reel 10 carries a plurality of usually equally spaced razor-like blades 12 with their cutting edges outwardly directed. When the pressure roller is held at a given, precise distance from the ends of the blades 12 the innermost layers of the material wound on the reel are cut and fall out as short lengths of material which are conveyed away from the apparatus in the manner understood and as is well-known and forms no part of our invention.

As is known, when the blades 12 become so dull as to improperly cut the lengths of material, the pressure between the roller-material-blades increases to the extent that it can be detected. Likewise, insertion of a blade 12 on the reel 11 may be backwards which results in increased pressure or a blade 12 may be broken or missing which results in decreased pressure.

With reference to FIG. 1, it may be seen that the reel 10 is mounted for driven rotation in the known manner and may be provided with a hub 14 and shaft 16. The specific type reel assembly depends on the material and the length of the staple to be cut, however certain features of the reel are germane to this invention. Specifically, the reel 10 is provided with a physically detectable anomaly 17 such as a gap in the reel, a magnetic anomaly, a reflective surface or any other like anomaly that may be detected as the reel 10 rotates. Mounted proximal the reel 10 in a cooperative position at a fixed point for sensing the anomaly 17 is a detector or sensor 18 which will generate an electrical signal indicative of the position of the anomaly as it passes the fixed or reference point. Each of the blades 12 in the reel are provided with a visibly discernible designation such as a alpha-numeric code, which identifies each blade 12 relative to the anomaly 17.

The pressure roller 11 is carried by a roller assembly 20 pivotally mounted to a frame member 21 via a pivot shaft 22. The assembly 21 includes a massive base 23 pivotally mounted on shaft 22 and connected distal the shaft 22 to an actuator 24, shown in FIG. 1 as a hydraulic cylinder. The actuator moves the assembly 20 selectively to a position where the roller 11 engages the material on the reel 10 and to a position whereat the roller 11 is displaced from the reel 10. A sensor 26, such as a limit switch is cooperatively positioned to generate an electronic signal indicative of the position of the assembly 20.

It will be appreciated that the actuator 24 and the pivotal mounting of the roller assembly 20 are exemplary and merely conform to the customary method of mounting a pressure roller. It is to be understood that the roller 11 and assembly 20 may be mounted on any actuator structures which selectively move the same radially with respect to reel 10.

The pressure roller 11 is of lightweight construction, hollow in the embodiment shown, and is mounted to the massive base 23 by a lightweight yoke 27 which is mounted on a pivot shaft 28 carried by the massive base 23. A low mass shaft 29 carried by the yoke 27 supports a set of roller bearings 31 and the roller 11. The yoke 27 is designed to be rigid and resist torsion, with minimum weight obtained through yoke contour design and material choice. The yoke pivot 28 is located to allow movement of the pressure roller bearings 31 substantially in the direction of a line through the center of the pressure roller 11 and reel 10 and perpendicular to their axis. Movement of the yoke 27 about the pivot shaft 28 is limited by a stop 32 mounted to the base 23. A pair of legs 33 extend from the yoke 27 toward the base 23 at each end of and perpendicular to the lightweight shaft 29 to cooperatively contact a pair of sensors 34 mounted in base 23. The sensors 34 are each mounted in a well 36 formed in the base 23 and retained therein by a stop member 37. A spring 38 resiliently biases each sensor against the stop members 37 with a force of predetermined quantity less than the failure force of the sensor 34. Thus, if the force transmitted to the sensors 34 is excessive, the springs 38 are compressed and the sensors 34 are unharmed. The sensors provide a dynamic electric output proportional to the magnitude of the force applied thereto. The sensors 34 are located one on either side of the pressure roller 11 to sense the forces substantially along a line through the centerline of the pressure roller 11 and the reel 10 and perpendicular to their axes.

It may be seen that the apparatus described thus far includes sensors providing information on three types of data. Sensor 18 indicates passage of the physical anomaly 17 by the fixed reference point. Sensor 26 indicates whether the pressure roller 11 is engaging the material to be cut and sensors 34 indicate the force being exerted at the pressure roller-material, reel interface. The data from these sensors is provided to a programmable computer 39 which includes in its database pertinent information about the specific reel 10 including such information as the number of blades 12, the spacing between the blades 12, the diameter of the reel 10 and the arc formed by the blades 12. With such information and the data provided by the sensors 18, the computer 39 is readily programmable to determine the position of the physical anomaly 17 at any time, and to determine the position of each blade at any time. The data provided by the sensors 34 is used by the computer to determine the force at the pressure roller 11 interface at any time, and the input from sensor 26 allows the computer 39 to identify the data input by sensor 34 as background data generated when the pressure roller 11 is not engaging the material or as data indicative of the forces in existence when the roller 11 is fully engaged.

Figure 5:
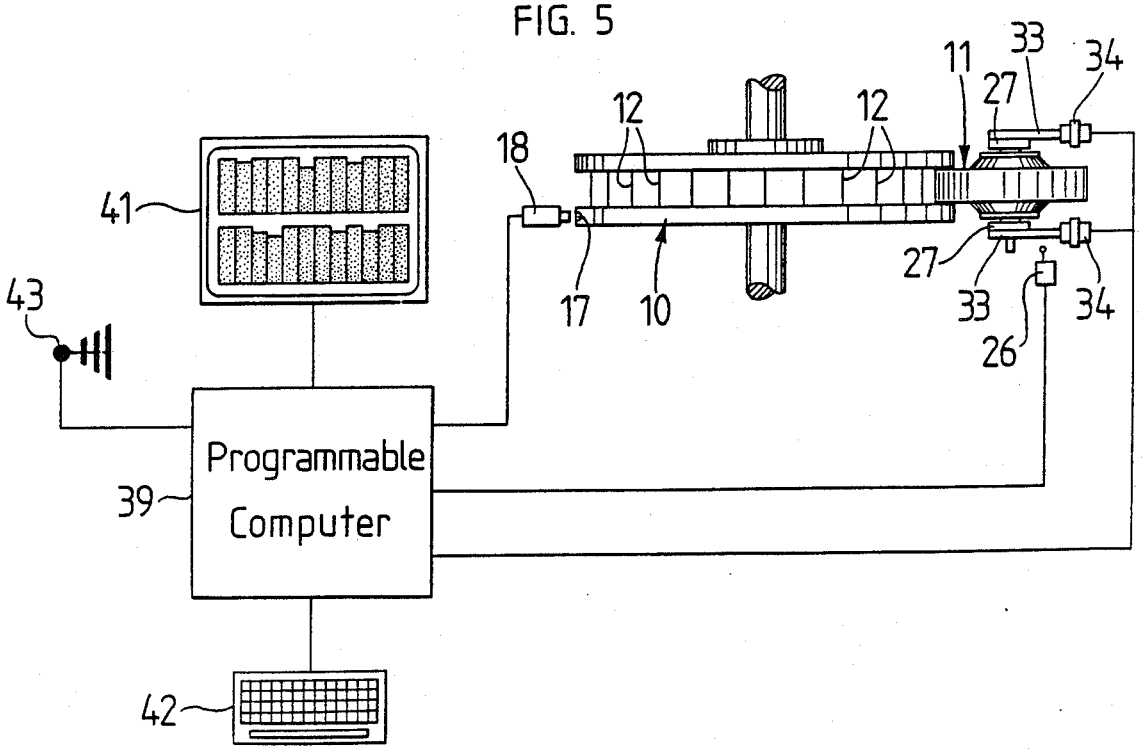
FIG. 5 is a pictorial schematic diagram of the connection of the sensors to the CPU and indicator device of our invention.

The combination of information provided allows the computer 39 to correlate the forces sensed by sensors 34 with the position of the individual blades 12 and thus monitor the condition of the individual blade 12 rather than the gross monitoring of the prior art. Further, the computer 39 provides a visual indication of the individual blade condition on a display monitor 41. For example, it may be convenient to generate a bar graph representing the force correlation for each blade 12 as shown in FIG. 5. The bars on the graph may be identified with the individual blades by the same alpha-numeric designator as appears on the reel 10 such that the operator can readily correlate the bar graph display to the blade. Also provided is a keyboard 42 which allows the operator to input data, control the operation of the apparatus, or change selected parameters. For example, depending on the type of reel and material, it may be desirable to provide visual and/or audio signals via an indicator 43 or the monitor 41 which indicate that the force associated with an individual blade 12 reaches various magnitudes. It may be desirable to change these magnitudes from the keyboard 42. Likewise, data may need to be entered concerning parameters of the particular material being cut or to assist in correcting the forces sensed for various physical reasons.

In operation, the apparatus is first calibrated with actuator 24 extended such that the pressure roller 11 is withdrawn from reel 10 and sensor 26 is engaged by the reel assembly 20. Sensors 34 send data to the computer 39 indicative of the non-loaded condition thus providing a reference level signal. Actuator 24 then moves the roller assembly 20 into its operating position. As the sensor 18 and 34 send their signals to the computer 39, it correlates these signals and generates the display on monitor 41. As a blade 12 becomes dulled, the forces associated with that blade increase and are displayed on the monitor 41. Likewise, if a blade 12 is missing or broken, the resultant variation in pressure will be detected by the system and displayed on the monitor. The operator upon observing the variation in force with an individual blade can decide which blade is the aberrant blade simply by referring to the alpha-numeric indicators on the monitor 41 and reel 11. Thus replacement of such blades is greatly facilitated.

The apparatus may also be programmed to give a warning to the operator upon specified conditions sensed by sensors 34 and may in fact stop the cutter apparatus on the basis of such forces. For example, if a blade became dull while the cutter was unattended or escaped notice by the operator, the system can be programmed to stop or give a warning at a specified force level. The spring loaded sensors 34 would, of course, be protected from excessive force by the compression of springs 38. Also as is well known, the reel 10 rotates at speeds up to several hundred rpm thus the use of the computer 39 allows the force on each blade 12 to be averaged over several revolutions such that a non-recurring aberration in the data relative to one blade does not result in an alarm condition. Also, the use of the computer 39 in the monitoring system allows the input data from the sensors to be corrected for speed associated phenomena which might yield erroneous results.

From the foregoing, it may be seen that the present invention is a great improvement over the apparatus and method of U.S. Pat. No. 3,744,361 in that it provides enhanced capability to monitor the dynamic condition of each blade rather than gross pressure sensing and response.

While we have shown our invention is one form, it will be obvious to those skilled in the art that it is not so limited but is susceptible of various changes and modifications without departing from the spirit thereof.

We claim:

1. In an apparatus for cutting fibers into shorter lengths wherein fibers are urged between the blades of a rotating reel assembly and a pressure roller, a reel for supporting said blades including means for identifying each blade relative to a fixed reference point on said reel assembly and sensor means for identifying said fixed reference point as said reel rotates wherein each blade is identifiable during high-speed operation of said rotating reel assembly.

2. The structure as defined in claim 1 wherein said means for identifying each blade comprises a visually perceptible symbol affixed to the reel proximal each blade and associated therewith.

3. The structure as defined in claim 2 wherein said means for identifying said fixed reference point comprises a sensor for detecting a physically perceptible discontinuity of said reel at said reference point.

4. The structure as defined in claim 1 wherein said means for identifying said fixed reference point comprises a sensor for detecting a physically perceptible discontinuity of said reel at said reference point.

5. In a cutter reel assembly having a plurality of blades mounted therein for cutting fibers into shorter lengths, a pressure roller for urging said fibers against said blades; means for sensing the angular position of said assembly; means for sensing the force applied to said pressure roller by the fiber on said reel assembly; means for providing an indication of the condition of the blades in said cutter reel assembly as a function of said angular position and the force applied to said pressure roller.

6. The structure as defined in claim 5 further comprising means for calibrating initial conditions of said means for sensing the force applied.

7. The structure as defined in claim 6 wherein said means for calibrating comprises a sensor cooperatively positioned relative to said pressure roller to generate a signal responsive to the disengagement of said pressure roller from said fibers.

8. The structure as defined in claim 5 wherein said means for sensing the angular position of said reel assembly comprises a sensor for detecting a physical anomaly at a specified location on said reel assembly and said reel assembly includes visible means for identifying each blade position relative to said physical anomaly.

9. The structure as defined in claim 8 wherein said physical anomaly is a variation in the reflectivity of light of said reel assembly at a specified position.

10. The structure as defined in claim 8 wherein said physical anomaly is a magnetic variation in a defined region of said reel assembly.

11. The structure as defined in claim 5 wherein said means for sensing the force applied to said pressure roller comprises a base structure supporting said pressure roller and having a mass substantially greater than said pressure roller, with said base structure cooperatively mounted to move said pressure roller between a fiber engaging position and a non-fiber engaging position; at least one sensor for sensing the force exerted on said base structure by said pressure roller.

12. The structure as defined in claim 11 further comprising a yoke member movably mounted to said base structure and supporting said pressure roller such that forces applied to said pressure roller are transmitted to said sensor by said yoke.

13. The structure as defined in claim 12 wherein said yoke supports said pressure roller on an axle passing through the center of rotation thereof and wherein said forces applied to the pressure roller are detected at each end of said axle by said sensor.

14. The structure as defined in claim 11 wherein said sensors are resiliently mounted to prevent damage thereto by excessive force exerted by said pressure roller.

15. The structure as defined in claim 5 wherein said means for providing an indication of the condition of said blades comprises a programmable computer having input from said means for sensing the angular position of said assembly and from means for sensing the force applied to said pressure roller, with said computer being programmed to manipulate the output of said position sensing means to identify each blade in said reel assembly as it passes said pressure roller and to assign to each blade a value based on the output of said force sensing means as said identified blade passes said pressure roller; and means cooperatively connected to said computer for displaying the value assigned to each blade.

16. The structure as defined in claim 15 wherein said means for displaying comprises a cathode ray tube.

* * * * *